US011384579B2

(12) United States Patent
Dreyer et al.

(10) Patent No.: US 11,384,579 B2
(45) Date of Patent: Jul. 12, 2022

(54) SLIDING DOOR ARRANGEMENT

(71) Applicant: ASSA ABLOY ENTRANCE SYSTEMS AB, Landskrona (SE)

(72) Inventors: Roger Dreyer, Bjarred (SE); Ola Ahlqvist, Harslov (SE); Ivan Rajic, Lund (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 204 days.

(21) Appl. No.: 16/606,916

(22) PCT Filed: Apr. 23, 2018

(86) PCT No.: PCT/EP2018/060262
§ 371 (c)(1),
(2) Date: Oct. 21, 2019

(87) PCT Pub. No.: WO2018/197373
PCT Pub. Date: Nov. 1, 2018

(65) Prior Publication Data

US 2020/0386025 A1 Dec. 10, 2020

(30) Foreign Application Priority Data

Apr. 25, 2017 (SE) ..... 1730116-9

(51) Int. Cl.
*E05D 13/00* (2006.01)
*E05D 15/10* (2006.01)

(52) U.S. Cl.
CPC .. *E05D 15/1042* (2013.01); *E05D 2015/1049* (2013.01); *E05D 2015/1057* (2013.01); *E05Y 2900/132* (2013.01)

(58) Field of Classification Search
CPC ..... E05D 15/1065; E05D 15/1042; E05D 2015/1049; E05D 2015/1057;
(Continued)

(56) References Cited

U.S. PATENT DOCUMENTS 3,585,757 A * 6/1971 Ritchie ..... B64C 1/1438 49/215
4,452,014 A * 6/1984 Markus ..... E05F 15/646 49/360

(Continued)

FOREIGN PATENT DOCUMENTS

DE 1236970 3/1967
DE 8913893 3/1991

(Continued)

OTHER PUBLICATIONS

International Search Report mailed in PCT/EP2018/060262 dated Jul. 25, 2018.
SE Search Report mailed in SE 17301169-9 dated Nov. 15, 2017.

*Primary Examiner* — Jerry E Redman
(74) *Attorney, Agent, or Firm* — Wissing Miller LLP

(57) ABSTRACT

A guiding assembly (300) for guiding a sliding door leaf (101) movable along a sliding door rail (110) is provided. The guiding assembly (300) comprises a bogie (130) having a first end (132) being provided with a first steering member (136) and a second steering member (138), and an opposite end (134) comprising at least one guiding element (122) being engaged with the sliding door rail (110), wherein the bogie (130) is connected to the sliding door leaf (101). The guiding assembly (300) further comprises a guiding rail (140) having first end section (**140*a*) and a second end section (140*b*). The bogie (130) is configured to pivot relative the sliding door leaf (101) as the second steering member (138) travels along the guiding rail (140**).

12 Claims, 4 Drawing Sheets

(58) Field of Classification Search
CPC ..... E05D 2015/1063; E05Y 2900/132; E05Y 2201/64; E05Y 2201/652; E05Y 2201/684; E05Y 2800/12; E05F 15/646
USPC ..... 49/213, 209, 211, 214, 215, 216, 222, 49/221, 409, 425, 415, 427, 426
See application file for complete search history.

(56) References Cited

U.S. PATENT DOCUMENTS 5,193,319 A * 3/1993 Claassen ..... E04B 2/827 52/243.1
5,461,829 A 10/1995 Lehto et al.
5,836,111 A * 11/1998 Tak ..... E05D 15/581 49/425
2002/0053166 A1* 5/2002 Fries ..... E05D 15/10 49/213
2003/0188488 A1* 10/2003 Carlsson ..... B61D 19/005 49/118
2006/0108079 A1* 5/2006 Burggraaf ..... E05D 15/1013 160/206
2012/0066978 A1* 3/2012 Caimi ..... E05D 15/1042 49/409
2014/0182212 A1* 7/2014 Bortoluzzi ..... E05D 15/1042 49/420
2016/0245006 A1* 8/2016 Joussellin ..... E06B 3/46
2019/0128035 A1* 5/2019 Harari ..... E05D 15/1005

FOREIGN PATENT DOCUMENTS

| | | |
|---|---|---|
| DE | 9405483 | 8/1994 |
| FR | 2980510 | 3/2013 |
| JP | 0620843 | 3/1994 |
| JP | 06137033 | 5/1994 |
| JP | 2003253949 | 9/2003 |
| SE | 418314 | 11/1978 |

* cited by examiner

SLIDING DOOR ARRANGEMENT

This application is a 371 of PCT/EP2018/060262 filed on Apr. 23, 2018, published on Nov. 1, 2018 under publication number WO 2018/197373, which claims priority benefits from Swedish Patent Application No. 1730116-9 filed on Apr. 25, 2017, the disclosure of which is incorporated herein by reference.

TECHNICAL FIELD

The present invention relates to a guiding assembly for guiding a door leaf. More preferably the present invention relates to a guiding assembly for sliding doors and a sliding door assembly comprising said guiding assembly.

BACKGROUND

The use of automatic sliding doors is commonly known to facilitate access to buildings, rooms and other areas.

Conventional sliding doors are driven by a drive unit mounted at the door frame for driving a bracket along a rail via a driving belt. The bracket, in turn, is attached to the sliding door leaf, whereby the sliding door leaf is driven by the drive unit.

In some cases the sliding door serves as a barrier which in many cases requires a heavier door. Usage of sliding doors as sealing or hermetic barriers brings about several issues. Conventional sliding door arrangements using sealing brushes may not provide a sufficient sealing effect in a closed position. However, if the sealing is too tight e.g. by the door leaf being pushed to tightly towards the sealing members of the door fame, the movement of the sliding door leaf is negatively affected due to the increased friction. There is thus a need to find a balance between sufficient sealing and easy movement of the sliding door leaf.

For providing appropriate closing of the sliding door the horizontal moving sequence, when approaching the closing end position, normally changes to a three-dimensional motion in which the sliding door not only moves the last horizontal distance, but also moves downwards and inwards, to close against the underlying ground or floor, as well as towards the frame. When opening the door the opposite motion is required.

Sliding doors configured to close in the above described manner thus require a greater starting force in the opening cycle as the door actually needs to be lifted in the vertical direction. Standard drive unit are normally not dimensioned to provide such high force.

An actuator is therefore often used in conventional automatic sliding doors system to provide assistance during the initial opening. After the door has accelerated from the closed position the torque of the main drive unit is enough to drive the door leaf in the horizontal direction, whereby the actuator is deactivated. The provision of the additional actuator leads to a more costly, larger and complex drive assembly for a sliding door arrangement.

It would therefore be beneficial to provide a solution which is less complex and does not require any additional actuator or power device to achieve the initial opening sequence of the sliding door while at the same time provide an improved sealing.

SUMMARY

An object of the present invention is therefore to provide a solution to the above-mentioned problem, reducing the disadvantages of prior art solutions.

A guiding assembly for guiding a sliding door leaf along a sliding door rail is provided. The guiding assembly comprises a bogie having a first end being provided with a first steering member and a second steering member, and an opposite end comprising at least one guiding element being engaged with the sliding door rail, wherein the bogie is connected to the sliding door leaf. The guiding assembly further comprises a guiding rail having first end section and a second end section. The bogie is configured to pivot relative the sliding door leaf as the second steering member travels along the guiding rail.

The guiding assembly allows for a reduction of the complexity of the associated door operating assembly. Furthermore, the guiding assembly allows for efficient sealing when the sliding door leaf is in a closed position, i.e. at the end of the opening cycle, and for retrofitting to existing sliding door arrangements. During closing, the door is moved in a downward and inward direction by the use of the guiding rail. Hence, an effective seal is achieved for doors being of different weights and having different dimensioned gaps between the door leaf and the door frame.

According to second aspect of the invention a method for providing a sliding door assembly for operating a sliding door leaf driven by a drive unit along a sliding door rail is provided. The method advantageously comprises positioning the door leaf relative the sliding door rail, positioning a guiding rail relative the sliding door rail and connecting a bogie to the drive unit and the door leaf. In accordance with the aforementioned embodiments, the bogie has a first end being provided with a first steering member and a second steering member, and an opposite end comprising at least one guiding element being engaged with the sliding door rail. The bogie is configured to pivot relative the sliding door leaf as the second steering member travels along the guiding rail.

Thus, a less costly and less complex method for providing a sliding door assembly is obtained, since it does not require any fitting of additional actuators and provides for easy individual alterations for each desired size and weight of the door leaf to gain a sufficient seal.

According to yet another aspect of the invention a method for operating a sliding door leaf driven by a drive unit along a sliding door rail is provided. The method preferably comprises providing a door operating assembly according to any of the previously described embodiments, as well as driving said drive unit from a first to a second position, whereby in the first position the bogie is configured to be engaged with the sliding door rail by the first steering member and the guiding element, and in the second position the bogie is configured to be engaged with the sliding door rail by the guiding element and engaged with the guiding rail by the second steering member. Thus, the door is lowered and moved inwards towards the door frame in the end of the closing cycle, allowing for the door leaf to be sealed.

BRIEF DESCRIPTION OF THE DRAWINGS

Embodiments of the invention will be described in the following; reference being made appended drawings which illustrate non-limiting examples of how the inventive concept can be reduced into practice.

DETAILED DESCRIPTION OF THE EMBODIMENTS

Figure 1:
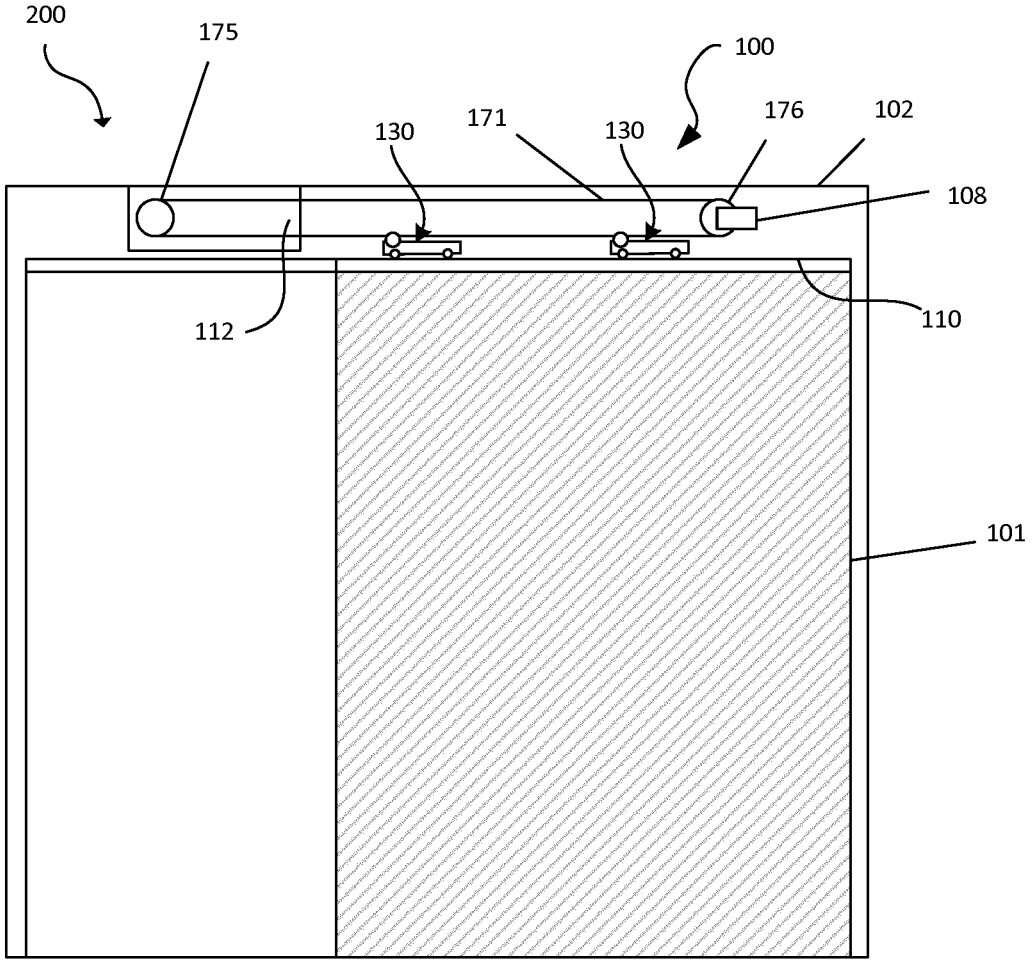
FIG. 1 is a front view of a sliding door assembly comprising a door operating assembly according to one embodiment.
Figure 2:
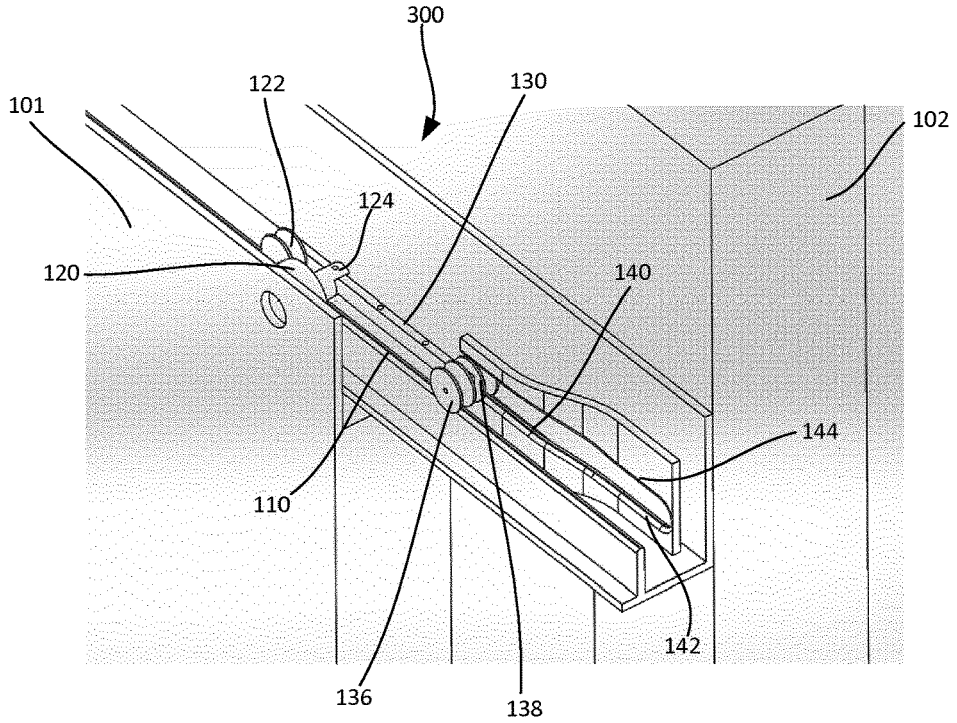
FIG. 2 is a cross-sectional view of a guiding assembly according to one embodiment, for use e.g. with the sliding door assembly of FIG. 1.

An example of a door operating assembly 100 will be described in the following. With reference to FIGS. 1 and 2 a sliding door assembly comprises a sliding door leaf 101, a drive unit 112, a sliding door rail 110, and a door operating assembly 100 for driving the sliding door leaf 101. The sliding door leaf 101 is driven by the drive unit 112 along the sliding door rail 110 which is fixed relative a door frame 102.

The door leaf 101 may be made of wood, metal, plastic, glass or other suitable materials. The door leaf 101 may also be a fire proof door having a fire resistant core made of various suitable materials generally known in the art. Fire resistant door leafs are typically constructed to prevent or delay transfer of thermal energy, i.e. heat, from one side of the door leaf 101 to the opposite side 101. Due to its construction these door leafs 101 are often comparatively heavy.

The door leaf 101 is slidingly connected to the sliding door rail 110 for example by means of at least one bogie 130. The bogie 130 is preferably engaging with the sliding door rail 110 via at least one low friction wheel allowing the sliding door leaf 101 to move into a closed and open position along the horizontal sliding door rail 110.

Several applications for an automated sliding door assembly require the sliding door leaf 101 to serve as a barrier minimizing any transfer of mediums between the rooms separated by the sliding door assembly. For such applications the sliding door leaf 101 may be provided with sealings adapted to be pushed against the door frame 102 and/or the ground when the sliding door leaf 101 is in a closed position.

Further referring to FIG. 1, the sliding door assembly may comprise a drive unit 112 which may be of any conventional type. Typically, the drive unit 112 comprises an electric motor and a reduction gearing providing the necessary torque to move the sliding door leaf 101 between the open and closed position. According to the present example a belt drive arrangement connects the drive unit 112 with the bogie 130 which works as a drive member. Advantageously, the drive unit 112 is adapted to be connected to the door frame 102 of the sliding door assembly, or even mounted within the interior of the upper part of the door frame 110.

The bogie 130 is connected to a belt 171 driven by the drive unit 112. The drive belt 171 is preferably a synchronous endless drive belt extending between two driving wheels 175 and 176. The driving wheel 175 is directly driven by the drive member 112 and the second driving wheel 176 is rotationally supported by a console 108 being fixed to the door frame 102. The driving wheels 175, 176 may be cogged wheels.

Due to the weight of the sliding door leaf 101 it is difficult to provide sufficient sealing between the door leaf 101 and the floor as well as between the door leaf 101 and the door frame and/or between a further door leaf 101. To enable a sufficient sealing a guiding assembly 300 is provided. As will be explain in the following, the guiding assembly 300 comprises the bogie 130 and an associated guiding rail 140.

Figure 3:
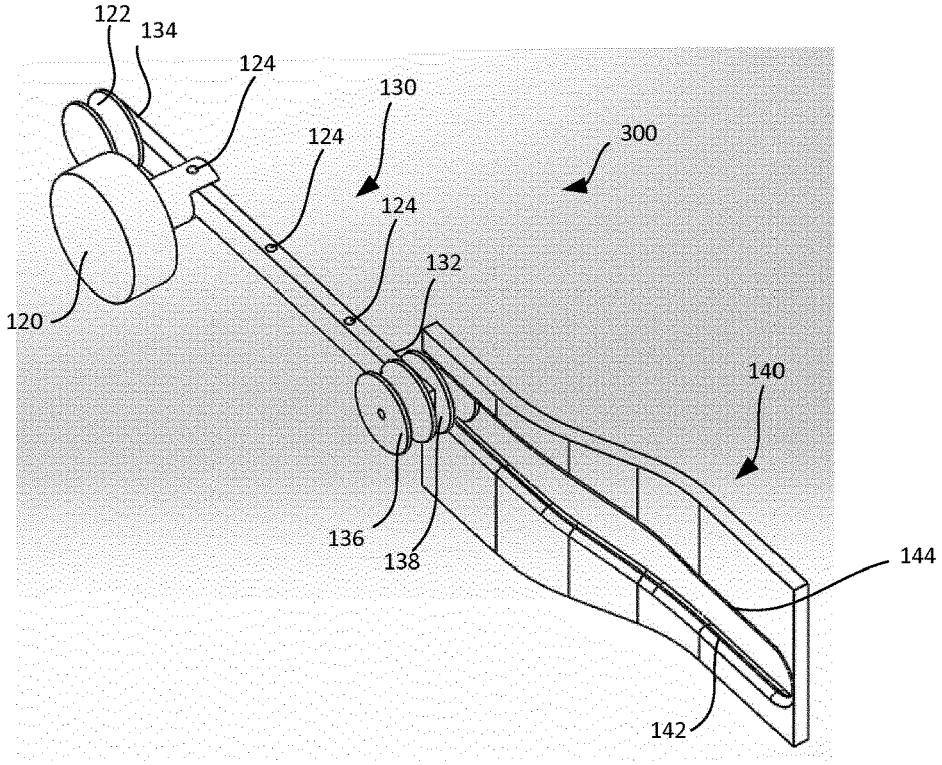
FIG. 3 is a cross-sectional view of the guiding assembly shown in FIG. 2.

Now turning to FIGS. 2 and 3, a guiding assembly 300 is shown comprising a bogie 130 and a guiding rail 140. The bogie 130, being provided as an elongated arm member, has one a first end portion 132 being provided with two steering members 136, 138. The two steering members 136, 138 are arranged on opposite sides of the bogie 130. In one embodiment, the two steering members 136, 138 are in the form of a first steering wheel 136 and a second steering wheel 138.

The bogie 130 further comprises a second end portion 134 being opposite of the first end portion 132 of the bogie 130. The second end 134 is provided with at least one guiding element 122 engaging with the sliding door rail 110. The guiding element 122 may be one guiding wheel 122 or two guiding wheels being arranged opposite each other on the bogie 130.

The bogie 130 is pivotally connected to a door leaf attachment element 120 which is attached to the door leaf 101, so as when the bogie 130 moves the door leaf 101 moves correspondingly. The connection between the bogie 130 and the door leaf attachment element 120 may for example be done by attachment means 124 arranged on the bogie 130. In the embodiment shown in FIGS. 2-3 the bogie 130 comprises three attachment means 124, however it should be understood that the bogie 130 could comprise any suitable number of attachment means 124. Preferably, the door leaf attachment element 120 may be easily movable on the bogie 130, so as to allow the guiding assembly 300 to be adaptable to different door leafs and door frame 102. By altering the position of the door leaf attachment element 120 the arrangement 100 can account for different sized gaps which are to be sealed. The attachment means 124 may be screw holes and the door leaf attachment element 120 may be a fork shaft.

In the embodiment shown in FIGS. 2-3 the door leaf attachment element 120 is arranged close to the second end portion 134 of the bogie 130. However, the door leaf attachment element 120 could also be arranged in the middle of the bogie 130 or closer to the first end portion 132 of the bogie 130.

Figure 5:
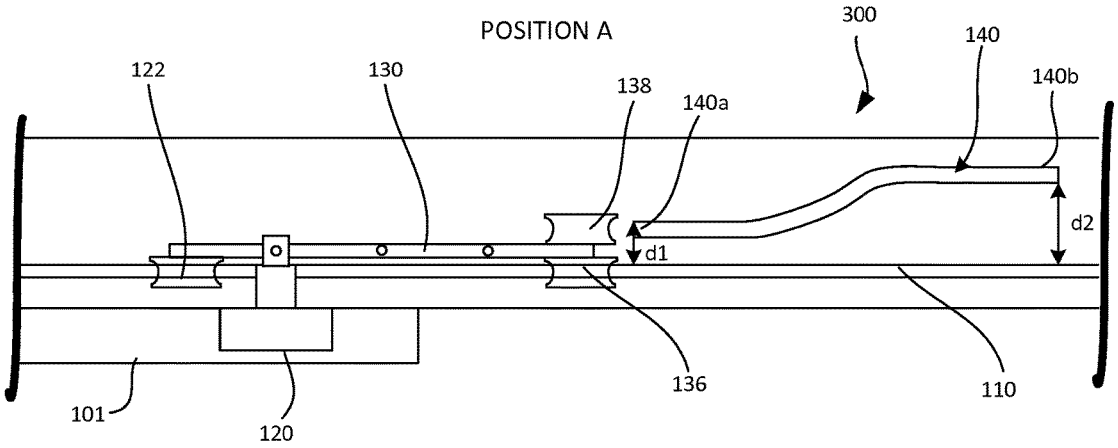
FIG. 5 is a top view of the guiding assembly shown in FIG. 2 when in a first position corresponding to an not closed position of an associated door leaf.
Figure 6:
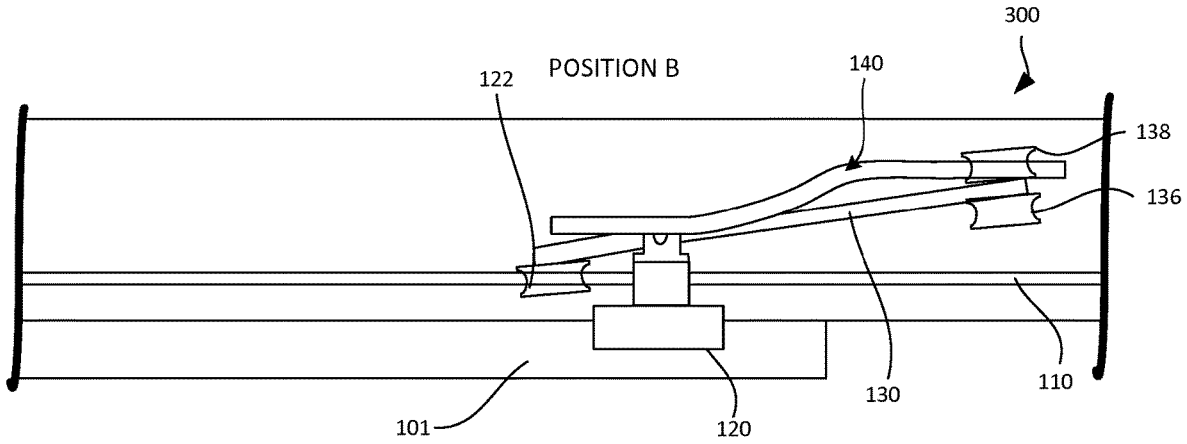
FIG. 6 is a top view of the guiding assembly shown in FIG. 2 when in a second position corresponding to a closed position of an associated door leaf.

The bogie 130 may be pivot between a first position A (as shown in FIG. 5) and a second position B (as shown in FIG. 6). In the first position A the at least one guiding wheel 122 and the first steering wheel 136 are engaged with the sliding door rail 110 whereas the second steering wheel 134 is running freely, not being engaged to any rail. When the bogie 130 is arranged in the second position B the at least one guiding wheel 122 is engaged with the sliding door rail 110 and the second steering wheel 134 is engaged with a guiding rail 140 extending substantially parallel with the sliding door rail 122. Hence, the first steering wheel 136 is engaged with the sliding door rail 110 until the second steering wheel 138 engages with the first end section 140*a* of the guiding rail 140. The different positions will be described more in detail with reference to FIGS. 5 and 6. In position B the bogie 130 has pivot in the horizontal plane relative when in position A.

The guiding assembly 300 provided herein has several benefits. First of all, the guiding assembly 300 can be used for all kinds of door leaf weights to provide a sufficient seal. Since the assembly can be used for heavy doors while still providing a good sealing effect, the arrangement of a bogie 130 and a guiding rail 140 is especially useful for fire doors. Additionally, thanks to the fact that the door leaf 110 is attached to the bogie 130, the amount of noise during opening/closing of the door leaf is reduced.

In one embodiment, as shown in FIGS. 2 and 3, the guiding rail 140 comprises both a bottom rail 142 and a top rail 144, where the top rail 144 is arranged above the bottom rail 142. In this way the second steering wheel 138 is fitted against the top rail 144 so as to ensure that the seal is sufficiently pressed against the floor and/or the door frame regardless of the weight of the sliding door leaf 101. This is especially beneficial when the door leaf 101 is lightweight, since the mass of the door may not be enough to press the sealing by itself.

FIGS. 4*a-d* schematically illustrates different embodiments of the guiding rail 140. In the embodiment shown in FIG. 4*a*, the first section 140*a* and the second section 140*b* of the guiding rail 140 are flat. The guiding rail 140 further comprises an intermediate section 140*c*, arranged between the first and the second section 140*a*, 140*b*. The intermediate section 140*c* is inclined in a negative direction. The inclined section 140*c* is tilted such that the first section 140*a* is arranged at a height h higher than the second section 140*b*. When moving along the intermediate section 140*c* the bogie 130 will pivot not only in the horizontal plane, but also in a vertical plane. Such pivoting will lower the position of the attachment means relative the guiding wheel 122 such that the entire door leaf 101 will lower vertically.

Figure 4A:
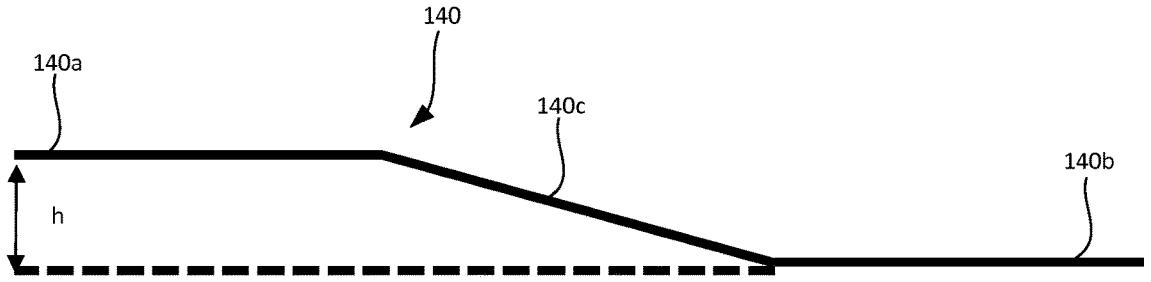
FIGS. 4*a-d* are schematic side views of different embodiments of a guiding track in a guiding assembly.
Figure 4B:
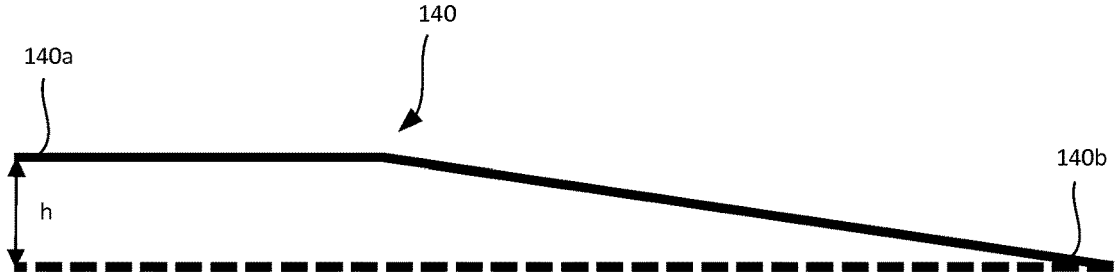

In the embodiment shown in FIG. 4*b*, the first section 140*a* of the guiding rail 140 is flat and the second section 140*b* of the guiding rail 140 is inclined in a negative direction. The second section 140*b* is tilted such that the first section 140*a* is arranged at a height h higher than the lowest part of the second section 140*b*.

Figure 4C:
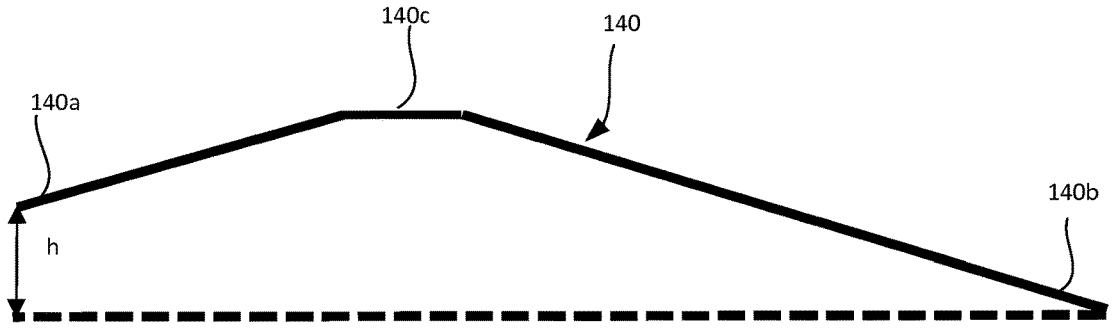

In the embodiment shown in FIG. 4*c*, the first section 140*a* of the guiding rail 140 inclined in a positive direction and the second section 140*b* of the guiding rail 140 is inclined in a negative direction. The guiding rail 140 further comprises an intermediate section 140*c*, arranged between the first and the second section 140*a*, 140*b*. Here the intermediate section 140*c* is flat. The first section 140*a* is positively inclined to facilitate the disengagement of the first steering wheel 136 from the sliding door rail 110. The second section 140*b* is negatively inclined in order to lower the position of the sliding door leaf 101. The lowest portion of the first section 140*a* is arranged at a height h higher than the second section 140*b*.

Figure 4D:
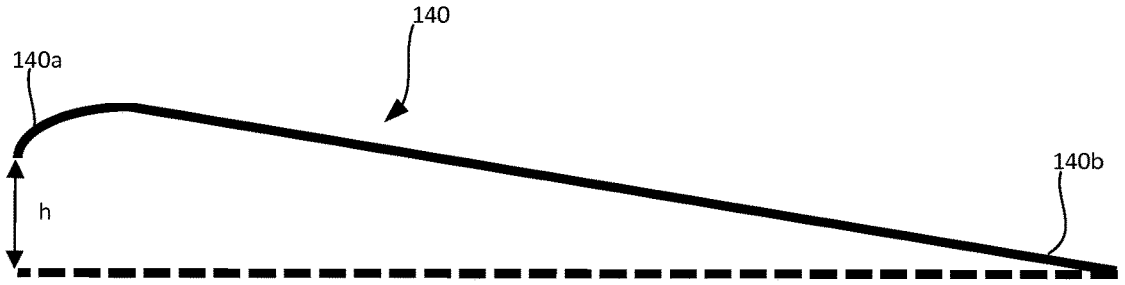

In the embodiment shown in FIG. 4*d*, the first section 140*a* of the guiding rail 140 inclined in a positive direction and the second section 140*b* of the guiding rail 140 is inclined in a negative direction. Here, no intermediate or flat section is present. The lowest portion of the first section 140*a* is arranged at a height h higher than the lowest part of the second section 140*b*.

Although the embodiments shown in FIGS. 4*a-d* are shown as a guiding rail 140 comprising only a bottom rail 142 it should be understood that the same principle applies if the guiding rail 140 comprises both a bottom rail 142 and a top rail 144. Furthermore, the geometries of the guiding rail 140 are mere examples, and other geometries may also be used.

Turning to FIGS. 5 and 6 a bogie 130 being in a first position A respectively a second position B is shown, the first position A corresponding to the bogie 130 being solely arranged on the sliding door rail 110 and the second position B corresponding to the bogie being arranged on both the sliding door rail 110 and the guiding rail 140, i.e. in an opening/closing position of the sliding door leaf 101.

The operating assembly 100 is arranged to move from the first position A, where the sliding door leaf 101 is in an opened position, to a second position B, where the sliding door leaf 101 is moved downwards and inwards to seal against the door frame and/or the floor when the bogie 130 moves along the sliding door leaf 101 and the guiding rail 140.

As seen in FIG. 5, the guiding rail 140 extends partly parallel with the sliding door rail 110. The guiding rail 140 comprises a first section 140*a* and a second section 140*b*, where the first section 140*a* is the section being in proximity to the bogie 130 when it is in a first section A. The first section 140*a* of the guiding rail 140 is arranged at a horizontal distance d1 from the sliding door rail 110, and the second section 140*b* of the guiding rail is arranged at a horizontal distance d2 from the sliding door rail 110. The distance d1 is smaller than the distance d2 in order to guide the door leaf 101 inwards. Preferably, the distance d1 is such that it allows for easy engagement between the guiding rail 140 and the second steering wheel 138. Hence the width of the bogie 130 and the steering wheels 136, 138 should be such that the second steering wheel 138 easily engages with the guiding rail 140.

In the first position A, the guiding wheel 122 and the first steering wheel 136 are engaged with the sliding door rail 110 whereas the second steering wheel 138 is running freely. Moving from the first position A towards the second position B, the second steering wheel 138 engages with the first section 140*a* of the guiding rail 140 and moves along the rail 140 towards the second section 140*b* of the guiding rail 140. Due to the geometry of the guiding rail 140 once the second steering wheel 138 engages with the first section 140*a* of the guiding rail 140, the first steering wheel 136 is forced out from the sliding door rail 110. Hence, the first steering wheel 136 is disengaged from the sliding door rail 110 at the same time as, or just after, the second steering wheel 138 engages with the first section 140*a* of the guiding rail 140.

Hence in the second position B, the second steering wheel 138 is engaging with the guiding rail 140 so as to force the first steering wheel 136 from its position in the sliding door rail 110 to a position where it is running freely. The first steering wheel 136 may be disengaged from the sliding door rail 110 by an initial positive inclination (as illustrated in FIGS. 4*c-d*) of the guiding rail 140, so as to raise the position of the second steering wheel 140*b* and thus also raise the arm and correspondingly also the position of the first steering wheel 140*a*. It is important to note that the at least one guiding wheel 122 is still engaging with the sliding door rail 110.

The guiding wheel 122 never disengages from the sliding door rail 110, and is arranged to carry a majority of the weight of the sliding door leaf 101. Preferably, the guiding wheel 122 is arranged to carry 50 to 90% of the weight, and more preferably around 75% of the weight of the sliding door leaf 101. In this way, the majority of the weight is remains on the sliding door rail 110. The weight distribution may be controlled by adjusting the position of the attachment means 120 on the bogie 130.

The first and second steering wheel 136, 138 are arranged to carry the remaining load of the sliding door leaf 101. When the operating assembly 100 is in a first position A, the first steering wheel 136 carries the remaining load by itself and when the assembly 100 is in a second position B the second steering wheel 138 carries the load. In an intermediate position, i.e. a position between the first position A and the second position B where both steering wheels are engaged in a rail 110, 140, the weight on the wheels is evenly distributed between the first and second steering wheels 136, 138. The weight carried by the steering wheels 136, 138 is sufficient to press the seals against the floor and/or the door frame.

Thus, the guiding assembly 300 may enable the sliding door leaf 101 to move in a direction extending inwardly as well as downwardly from its open position. Accordingly, a non-complex door operating assembly 100 which allows a tight sealing towards the door frame 102 as well as the ground when the sliding door leaf 101 is in a closed position is obtained.

According to the above description a sliding door assembly is provided. The sliding door assembly comprises a sliding door leaf 101, a drive unit 112, and a sliding door rail 110, the drive unit 112 being configured to drive the door leaf 101 along the rail 110. The sliding door assembly 200 further comprises a guiding assembly 300 according to any of the previously described embodiments. Thus, a sliding door assembly with a more efficient sealing can be provided. Furthermore, it allows for a sliding door assembly which is cheaper to manufacture since the operating mechanism does not require adjustments depending on the size of sliding door leafs.

According to another aspect of the invention a method for providing a sliding door assembly for operating a sliding door leaf 101 driven by a drive unit 112 along a sliding door rail 110 is provided. The method advantageously comprises positioning the door leaf 101 relative the sliding door rail 110, positioning a guiding rail 140 relative the sliding door rail 110 and connecting a bogie 130 to the drive unit 112 and the door leaf 101. In accordance with the aforementioned embodiments, the bogie 130 has a first end 132 being provided with a first steering member 136 and a second steering member 138, and an opposite end 134 comprising at least one guiding element 122 being engaged with the sliding door rail 110. The bogie 130 is configured to by the first steering member 136 engage with the sliding door rail 110 or by the second steering member 138 engage with the guiding rail 140.

Thus, a less costly and less complex method for providing a sliding door assembly is obtained, since it does not require any fitting of additional actuators and provides for easy individual alterations for each desired size and weight of the door leaf to gain a sufficient seal.

According to yet another aspect of the invention a method for operating a sliding door leaf 101 driven by a drive unit 112 along a sliding door rail 110 is provided. The method preferably comprises providing a guiding assembly 300 according to any of the previously described embodiments, as well as driving said drive unit 112 from a first to a second position, whereby in the first position the bogie 130 is configured to be engaged with the sliding door rail 110 by the first steering member 136 and the guiding element 122, and in the second position the bogie 130 is configured to be engaged with the sliding door rail 110 by the guiding element 122 and engaged with the guiding rail 140 by the second steering member 138. Thus, the door is lowered and moved inwards towards the door frame in the beginning of the closing cycle, allowing for the door leaf to be sealed.

It should be appreciated that even though numerous characteristics and advantages of the present invention have been set forth in the foregoing description, together with details of the structure and function of the invention, the description is only illustrative and changes may be made in detail, especially in matters of shape, size and arrangement of parts within the scope of the invention to the full extent indicated by the appended claims.

The invention claimed is:

1. A guiding assembly for guiding a sliding door leaf along a sliding door rail, the guiding assembly comprising:

a bogie being connected to the sliding door leaf, the bogie having a first end and an opposite second end, the first end comprising a first steering member configured to engage the sliding door rail and a second steering member, the opposite second end comprising at least one guiding element being engaged with the sliding door rail; and a guiding rail having a first end section and a second end section, wherein the second steering member is configured to engage the guiding rail with the first steering member being disengaged from the sliding door rail, and wherein the bogie is configured to pivot relative the sliding door leaf as the second steering member travels along the guiding rail.

2. The guiding assembly according to claim 1, wherein the bogie is configured to pivot between a first position and a second position, wherein in the first position the first steering member is engaged with the sliding door rail, and wherein in the second position the second steering member is engaged with the guiding rail.

3. The guiding assembly according to claim 1, wherein the first end section of the guiding rail is arranged at a first horizontal distance from the sliding door rail, and the second end section of the guiding rail is arranged at a second horizontal distance from the sliding door rail.

4. The guiding assembly according to claim 3, wherein a horizontal distance between the first end of the bogie and the sliding door rail is increased when the second steering member is engaged with the first end section of the guiding rail and travels towards the second end section.

5. The guiding assembly according to claim 3, wherein the first distance is smaller than the second distance.

6. The guiding assembly according to claim 1, wherein the guiding rail is at least partly inclined.

7. The guiding assembly according to claim 1, wherein the guiding rail comprises a bottom rail and a top rail.

8. The guiding assembly according to claim 1, wherein the bogie is connected to the sliding door leaf by a door leaf attachment element, the door leaf attachment element being repositionable along the bogie.

9. The guiding assembly according to claim 1, wherein the first steering member is a first steering wheel, and the second steering member is a second steering wheel.

10. The guiding assembly according to claim 1, wherein the at least one guiding element is a guiding wheel.

11. The guiding assembly according to claim 1, wherein the sliding door leaf is driven along the sliding door rail by a drive unit.

12. A method for providing a sliding door assembly for operating a sliding door leaf driven by a drive unit along a sliding door rail, the method comprising:

positioning the door leaf relative the sliding door rail;

positioning a guiding rail relative the sliding door rail; and connecting a bogie to the drive unit and the door leaf, wherein the bogie has a first end and an opposite second end, the first end of the bogie comprising a first steering member configured to engage the sliding door rail and a second steering member, the opposite second end comprising at least one guiding element being engaged with the sliding door rail, wherein the second steering member is configured to engage the guiding rail with the first steering member being disengaged from the sliding door rail, and wherein the bogie is configured to pivot relative the sliding door leaf as the second steering member travels along the guiding rail.

* * * * *